US005265676A

United States Patent [19]

Harrell

[11] Patent Number: 5,265,676

[45] Date of Patent: Nov. 30, 1993

[54] METHOD AND APPARATUS FOR RETRIEVING WIRE LINE FROM A WELL BORE

[75] Inventor: Robert W. Harrell, Hobbs, N. Mex.

[73] Assignee: Wada Ventures

[21] Appl. No.: 849,982

[22] Filed: Mar. 12, 1992

[51] Int. Cl.[5] ..... E21B 31/20

[52] U.S. Cl. ..... 166/301; 166/99

[58] Field of Search ..... 166/99, 301, 277; 175/19, 20, 323, 408; 52/157, 166; 15/104.33

[56] References Cited

U.S. PATENT DOCUMENTS 832,565 10/1906 Wilson ..... 52/157
930,792 8/1909 Perry ..... 52/157 X
1,230,711 6/1917 Hjermstad ..... 52/157
1,918,353 7/1933 Utley ..... 15/104.33
2,005,936 6/1935 Crane ..... 15/104.33

*Primary Examiner*—Stephen J. Novosad
*Attorney, Agent, or Firm*—Burns, Doane, Swecker & Mathis

[57] ABSTRACT

A wire line mass or bird nest is retrieved from a well bore by running into the well bore a coiled rod such that a lower pointed end of the coiled rod engages the wire line mass. The coiled rod is rotated to draw the wire line mass upwardly into entangled relationship with the coiled rod; whereupon the coiled rod and wire line mass can be removed together from the well bore. Outward projections on the coil rod prevent the wire line mass from slipping off the coiled rod.

14 Claims, 2 Drawing Sheets

METHOD AND APPARATUS FOR RETRIEVING WIRE LINE FROM A WELL BORE

BACKGROUND OF THE INVENTION

The invention relates to the retrieval of a wire line mass from a well bore, and especially to a tool and method for retrieving the wire line mass.

Downhole operations in oil and gas well bores are performed by equipment which is frequently run into the well bore by wire lines. Wire lines sometimes break or become separated and must be retrieved from the well bore. Unfortunately, the retrieval tools commonly used to engage or grab wire lines, such as barbed bodies, and shoe and washpipe tools, for example, are often unsuccessful and do no more than compress the wire line into a compacted mass, e.g., a so-called bird nest, which is even more difficult to retrieve. Among the most difficult wire lines to retrieve are insulated wire lines such as logging cables and electric wire lines of submergible pumps. Even if the prior retreival tools are successful, it often takes several attempts which is time-consuming, or may only retrieve small bits of the wire-line in each attempt. Often, the operator will resort to the use of tungsten-carbide cutting tools to mill the bird nest out of the well bore. That is a costly and time-consuming operation.

It is, therefore, an object of the present invention to minimize or obviate problems of the type discussed above.

Another object of the invention is to provide methods and apparatus for more easily and reliably retrieving a wire line mass from a well bore, especially insulated wire lines.

SUMMARY OF THE INVENTION

The objects of the invention, including those enumerated above, are achieved by a retrieval tool which comprises a coiled rod having a lower end oriented to enter a wire line mass in response to rotation of the coiled rod about its longitudinal axis. As the coiled rod rotates, it draws the wire line mass into entangled relationship with the coiled rod so that the coiled rod and wire line mass can be pulled together from the well bore.

Preferably, the coiled rod comprises a plurality of helical turns of equal diameter. A plurality of projections may be provided on at least some of the turns of the coiled rod for resisting downward slippage of the wire line mass from the coiled rod.

It is preferable that the lower end of the coiled rod is pointed and faces generally in the direction of rotation of the tool.

The upper end of the coiled rod is preferably threaded to a holder, and an upper end of the holder includes a screw thread for making connection with a threaded carrier.

A method aspect of the invention involves running a coiled rod into a well bore until a lower end of the coiled rod reaches the wire line mass. The coiled rod is rotated so that the lower end of the coiled rod enters the wire line mass, and the coiled rod draws the wire lie mass into entangled relationship with the coiled rod. The coiled rod and wire line mass are then removed together from the well bore.

BRIEF DESCRIPTION OF THE DRAWINGS

The objects and advantages of the invention will become apparent from the following detailed description of a preferred embodiment thereof in connection with the accompanying drawings, in which like numerals designate like elements, and in which.

DETAILED DESCRIPTION OF A PREFERRED EMBODIMENT OF THE INVENTION

Figure 1:
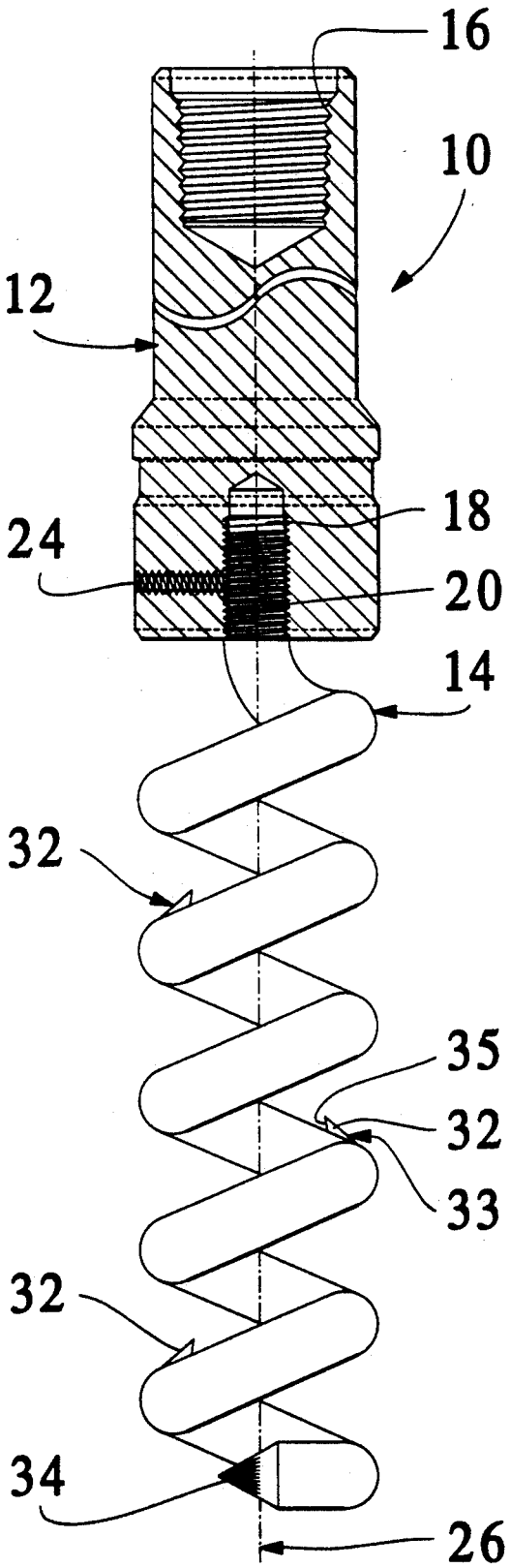
FIG. 1 is a side elevational view of a retrieval tool according to the present invention, with a holder portion of the tool being shown in longitudinal section.
Figure 2:
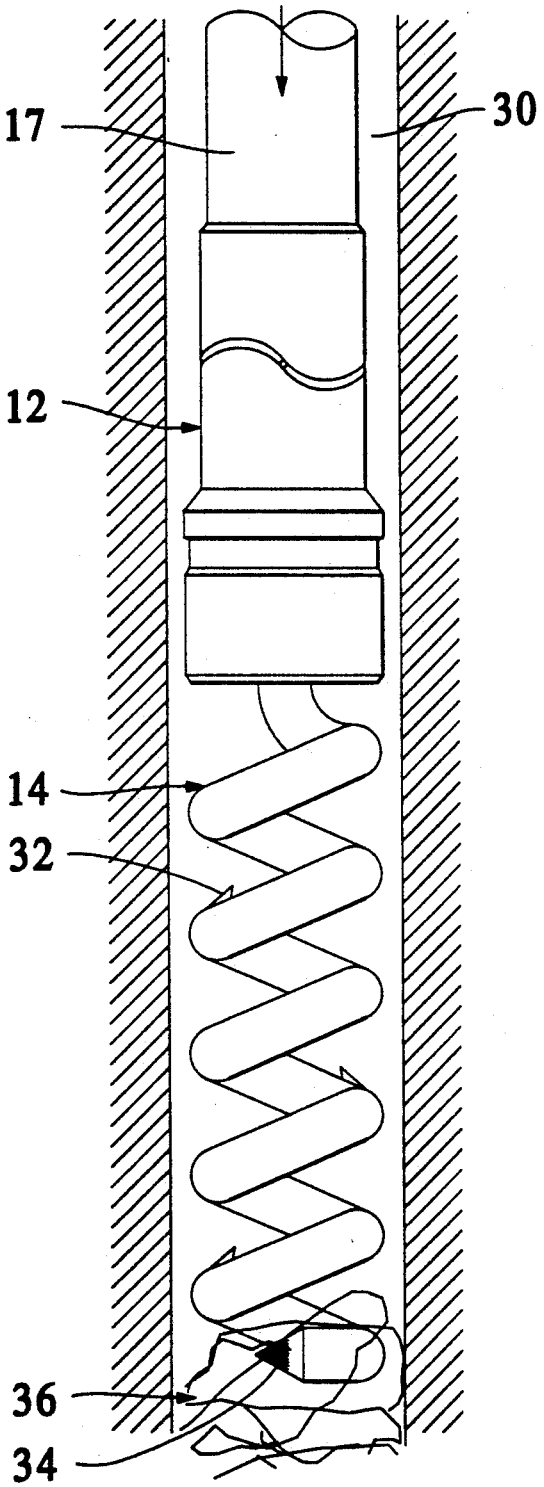
FIG. 2 is a side elevational view of the retrieval tool being run into a well bore and into engagement with a wire line mass.

A retrieval tool 10 according to the present invention comprises a holder 12 and a coiled rod 14 projecting downwardly from the holder 12. The holder 12 includes an upwardly open, internally screw-threaded socket 16 at its upper end for making threaded attachment to a carrier 17, such as a top sub. The top sub 17 is connected to an appropriate apparatus of the ground surface for effecting rotation of the top sub 17 and the retrieval tool 10 affixed thereto. Accordingly, the tool can be lowered into the well bore at the lower end of a string of tubing or well pipe and into engagement with a wire line mass.

At its lower end, the holder 12 includes a downwardly open, internally screw threaded socket 18 for receiving an externally threaded upper end 20 of the coiled rod 14. A set screw can be inserted into an internally threaded opening 24 formed in the holder to contact the rod and prevent it from being accidentally loosened.

The coiled rod 14 is formed of a stiff material, such as steel, and is helically coiled about a longitudinal axis 26. That axis 26 is vertically oriented when the tool 10 is run into a well bore 30.

The coiled rod 14 may possess any suitable number of helical turns, which are preferably of equal diameter, and is preferably provided with outward projections in the form of hooks or barbs 32. Each hook 32 includes a leading face 33 which is inclined downwardly in the direction of rotation of the coiled rod so that a wire line engaging the hook during rotation of the coiled rod will be cammed outwardly by the face 33 to enable the hook to easily travel past the wire line. A trailing face 35 of the hook is oriented for resisting the ability of a wire line to travel downwardly past the hook once the wire line mass has become entangled with the rod. That trailing face is disposed generally parallel to the axis 26 or perhaps is slightly inclined downwardly in the direction of rotation.

The hooks 32 can be suitably spaced along the coiled rod, such as by being placed every one and one-half turns.

The threaded upper portion 20 of the coiled rod extends longitudinally, whereas the lower end 34 extends circumferentially in the direction of rotation of the coiled member and is pointed in order to facilitate entry of the coiled rod into a wire line mass.

In practice, when it is necessary to retrieve a compacted wire line mass 36, such as a bird nest, the retrieval tool 10 is attached to a carrier, such as a top sub of a string of tubing, and is run into the well bore 30 into contact with the wire line mass 36, as depicted in FIG.

Figure 3:
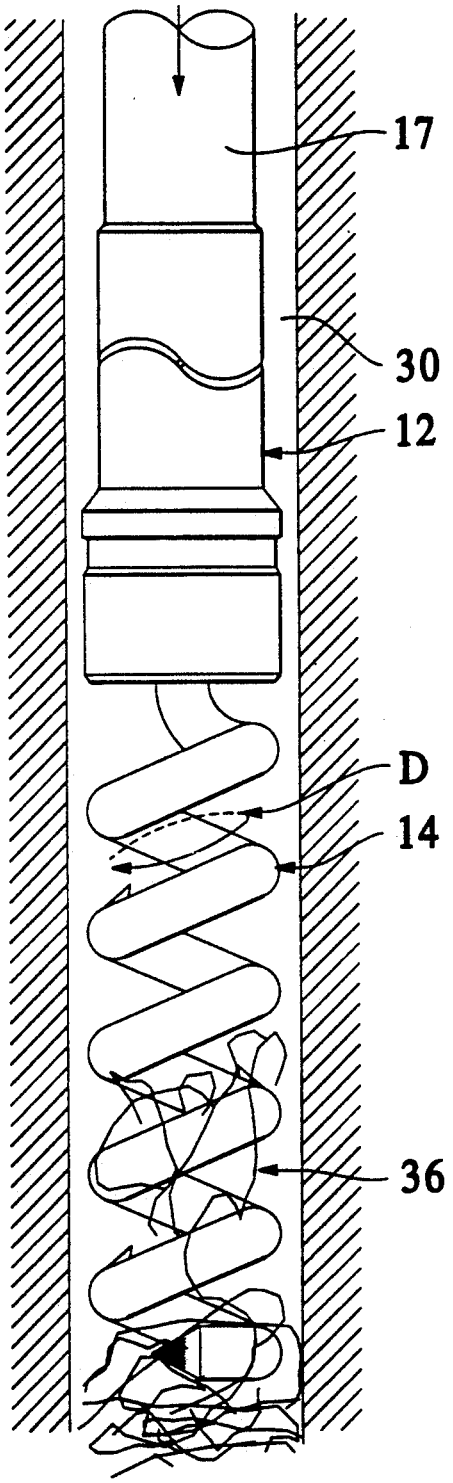
FIG. 3 is a view similar to FIG. 2 after the tool has been rotated to draw the wire line mass upwardly into entangled relationship with a coiled rod portion of the tool.

2. Thereafter, the tool is rotated in the direction D in which the pointed end 34 of the coiled rod points, i.e., clockwise as viewed from above in FIG. 3, so that the pointed end 34 enters the wire line mass 36, and the turns of the coiled member gradually draw the wire line mass upwardly into entangled relationship with the coiled rod, as depicted in FIG. 3. Eventually, the tool 10 is raised from the well bore along with the wire line mass. The hooks 32 resist any tendency for the wire line mass 36 to slip downwardly along the coiled rod. That is, the trailing faces 35 of the hooks 32 will abut the wire line and resist downward movement of the wire line mass relative to the coiled rod. The leading faces 33 of the hooks 32 are inclined and thus will not impede the rotation of the coiled member relative to the wire line mass.

A retrieval tool according to the present invention is particularly useful in the retrieval of insulated wire lines such as logging cable and electric wire used in submergible pumps.

Although the present invention has been described in connection with a preferred embodiment thereof, it will be appreciated by those skilled in the art that additions, modifications, substitutions, and deletions not specifically described may be made without departing from the scope of the invention as defined in the appended claims.

What is claimed is:

1. A retrieval tool for retrieving a wire line mass from a well bore, comprising a substantially vertical pipe, and a coiled rod arranged on one end of said pipe having means for entangling the wire line mass about said coiled rod in response to rotation of said coiled rod about its longitudinal axis, so that said coiled rod and wire line mass can be pulled together from the well bore.

2. A retrieval tool according to claim 1, wherein said coiled rod comprises a plurality of helical turns of equal diameter.

3. A retrieval tool according to claim 1 including at least one projection provided on at least some of the turns of said coiled rod for preventing the wire line mass from slipping off said coiled rod.

4. A retrieval tool according to claim 1, wherein said lower end of said coiled rod is pointed.

5. A retrieval tool according to claim 1, wherein said lower end of said rod extends circumferentially relative to a longitudinal axis about which said coiled rod is coiled.

6. A retrieval tool according to claim 1, wherein said coiled rod is formed of steel.

7. A retrieval tool according to claim 1 including a holder for connecting said coiled rod to said one end of said pipe, an upper end of said coiled rod is threadedly connected to said holder, an upper end of said holder including a screw thread for connection with a carrier.

8. A retrieval tool for retrieving a wire line mass from a well bore, comprising a rotatable holder including connecting means for making connection with a carrier, and a plurality of turns helically coiled about an axis, said coiled rod extending downwardly from said holder and rotatable therewith, a lower end of said coiled rod being generally pointed and facing generally in a direction of rotation of said holder so as to enter the wire line mass in response to rotation of said coiled rod to drawn the wire mass into entangled relationship with said coiled rod so that said coiled rod and wire mass can be pulled together from the well bore, said coiled rod including at least one projection for preventing the wire mass from slipping off said coiled rod.

9. A method of retrieving a wire line mass form a well bore, comprising the steps of running a coiled rod arranged on one end of a substantially vertical pipe into said well bore until a lower end of said coiled rod reaches said wire line mass, rotating said coiled rod so that said lower end of said coiled rod enters the wire line mass and said coiled rod draws said wire line mass upwardly into entangled relationship with said coiled rod; and removing said coiled rod and wire line mass together from said well bore.

10. A method according to claim 9 further comprising the step of engaging the wire line mass on at least one projection from said coiled rod.

11. A retrieval tool according to claim 3, wherein said at least one projection includes a trailing face which is disposed generally parallel to said longitudinal axis of said coiled rod.

12. A retrieval tool according to claim 3, wherein said at least one projection includes a leading face which is inclined downwardly in a direction of rotation of said coiled rod.

13. A retrieval tool according to claim 8, wherein said at least one projection includes a trailing face which is disposed generally parallel to said longitudinal axis of said coiled rod.

14. A retrieval tool according to claim 8, wherein said at least one projection includes a leading face which is inclined downwardly in a direction of rotation of said coiled rod.

* * * * *